US005178068A

United States Patent [19]

Junghans et al.

[11] Patent Number: 5,178,068

[45] Date of Patent: * Jan. 12, 1993

[54] PRINT UNIT CYLINDER FOR ROTARY PRESSES

[75] Inventors: Rudi Junghans, Wilhelmsfeld; Werner Weber, Sandhausen, both of Fed. Rep. of Germany

[73] Assignee: Heidelberger Druckmaschinen AG, Heidelberg, Fed. Rep. of Germany

[ * ] Notice: The portion of the term of this patent subsequent to Feb. 25, 2009 has been disclaimed.

[21] Appl. No.: 666,398

[22] Filed: Mar. 8, 1991

[30] Foreign Application Priority Data

Mar. 8, 1990 [DE] Fed. Rep. of Germany ..... 4007343
Jan. 31, 1991 [DE] Fed. Rep. of Germany ..... 4102858

[51] Int. Cl.[5] ..... B41F 1/28
[52] U.S. Cl. ..... 101/415.1; 101/378
[58] Field of Search ..... 101/375, 376, 377, 378, 101/415.1

[56] References Cited

U.S. PATENT DOCUMENTS

| | | | |
|---|---|---|---|
| 4,515,375 | 5/1985 | Bleckmann et al. | 101/378 |
| 4,742,769 | 5/1988 | Zeller | 101/216 |
| 4,790,245 | 12/1988 | Fischer et al. | 101/375 |
| 4,815,380 | 3/1989 | Fischer | 101/375 |
| 4,896,603 | 1/1990 | Dorow et al. | 101/375 |
| 4,964,338 | 10/1990 | Fantoni et al. | 101/415.1 |
| 5,090,319 | 2/1992 | Weber et al. | 101/375 |

FOREIGN PATENT DOCUMENTS

| | | | |
|---|---|---|---|
| 1367860 | 6/1964 | France | 101/415.1 |

*Primary Examiner*—Edgar S. Burr
*Assistant Examiner*—Ren Yan
*Attorney, Agent, or Firm*—Nils H. Ljungman

[57] ABSTRACT

The invention relates to a print unit cylinder for rotary presses, the cylinder having a narrow non-printing gap for accommodating the rubber blanket or pressplate ends, the gap running parallel to the axis of the cylinder, and also an elastomeric filler element for bridging the non-printing gap opening to thus prevent a sudden change of the roll characteristic when two interacting cylinders roll over the cylinder gaps.

20 Claims, 5 Drawing Sheets

PRINT UNIT CYLINDER FOR ROTARY PRESSES

BACKGROUND OF THE INVENTION

1. Field of the Invention

The invention relates to a print unit cylinder for rotary presses. The print cylinder having a narrow non-printing gap parallel to the cylinder axis for accommodating a rubber blanket, pressplate, or printing plate ends, and also a filler piece for bridging the non-printing gap opening in such a way as to prevent cylinder vibration when two interacting cylinders roll over the non-printing gaps.

2. Background Information

A print unit cylinder featuring a filler piece arranged in its cylinder gap or in the pit and supported on the bottom of the cylinder gap is known from German Patent No. DE-A-35 40 581. The filler piece itself is composed of metal and is arranged in the central third of the cylinder. The outer contour of the filler piece is adapted with high accuracy to the bearer ring diameter or the reference diameter of the drive gears. A filler piece is also provided in a second cylinder, so that both filler pieces in the interacting cylinders roll over each other.

It has now become apparent that when, for example, two rubber blanket cylinders roll over each other, the metal filler pieces cause a disturbing noise when they come into contact with each other, especially at high machine speeds. Furthermore, due to the rigid design and seating of the filler pieces, a shock cannot be avoided when they come into contact with each other since the elastic rubber blankets have a different roll behavior. Consequently, the cylinders cannot be prevented from vibrating. Negative phenomena cannot be avoided, especially when print unit cylinders without bearer rings are used, even when extremely exact tolerances have been assigned to the filler pieces. In addition, wear of filler pieces cannot be avoided because of the considerable shock load borne across their specific short overall length.

OBJECT OF THE INVENTION

Starting out from this prior art, the aim of the present invention is to bridge the cylinder gap of a print unit cylinder with a filler piece in such a way as to exclude sudden changes in the roll characteristic of two interacting cylinders, in order to substantially avoid vibrations and, thus, streaking in the print image.

SUMMARY OF THE INVENTION

The aim of the invention is achieved through the fact that the filler piece is preferably supported on the rubber blanket or the printing plate on either side of the gap opening, that the filler piece is preferably composed of elastic material or elastomeric material and has an outer contour which extends beyond the cylinder diameter, and that the filler piece features an elastic or elastomeric extension which reaches radially into the interior of the gap, the elastic force of this extension substantially permitting the filler piece to be firmly held in contact with the rubber blanket or the printing plate.

The fact that the filler piece is substantially supported solely on the rubber blanket or the printing plate on either side of the gap opening results in a filler-piece seating which is considerably more elastic in the case of a rubber blanket than in the case of a printing plate. This also corresponds with the roll characteristic of the two cylinder coverings, so that a sensitive adaptation of the roll behavior is achieved. In addition, the filler piece itself essentially comprises elastic or elastomeric material and, depending on its elasticity, its outer contour can extend a small distance beyond the cylinder diameter, so that the roll pressure of two interacting cylinders can also be sensitively maintained. The overhang of the filler piece can be adjusted to the hardness of the elastic or elastomeric material and is also dependent upon the length of the filler piece and therefore upon the capacity of absorption of compressive forces. In the case of long cylinders, it can be advantageous in practice if several filler pieces are used. By means of the elastic or elastomeric extension of the filler piece, any rigid connection with the cylinder body is avoided. In addition, a certain pretension can be transmitted to the filler piece, so that the elastic deformation of the outer contour of the filler piece is very small. Very little filler piece wear occurs due to the broad-surface design of the filler piece. Also, register corrections can be performed without any difficulties, and the very inexpensive filler piece can be renewed if desired, each time the rubber blanket is changed.

The elastic or elastomeric extension of the filler piece can preferably have a waved or latticed design, so that a very uniform elastic force can be created. Furthermore, it is advantageous if the lower end of the elastic or elastomeric extension is attached to a foil which is fitted tightly together with the rubber blanket into a U-shaped sheet-metal strip so that the filler piece is tensioned together with the end of the rubber blanket. The foil can comprise, for example, a metal foil composed of rustproof metal which is vulcanized into the elastic or elastomeric extension. When the rubber blanket is fitted tightly and tensioned onto the print cylinder, the filler piece is also automatically tightened into the groove, whereby, due to the large elastic deformation, differences in the tension conditions do not have a negative effect. In this embodiment of the invention, the changing of the rubber blanket also results in the automatic changing of the specific filler pieces.

In a modification of the development of the invention described above, the foil selected can preferably be a metal foil which surrounds the U-shaped sheet-metal strip in a hook-like configuration. The handling of this implementation of the invention does not differ from that described above, but it has the advantage that the filler piece can be used for any length of time, since there is no dependence between the filler piece, on the one hand, and on the rubber blanket, on the other. A further implementation variant is characterized by the fact that the foil can be attached to a bridging bar which engages in spring steel clasps mounted on the bottom of the gap. In this implementation of the invention, it is possible to change a filler piece or tension a filler piece independently without affecting the tensioned rubber blanket in any way.

One aspect of the invention resides broadly in a print cylinder for a rotary printing press, the print cylinder being for supporting at least one of: a rubber blanket and a printing plate about a circumference of the print cylinder, the print cylinder having a radius of curvature, and the print cylinder comprising: an axial groove disposed along the circumference of the print cylinder, the axial groove for receiving ends of the at least one of: the rubber blanket and the printing plate, the axial groove comprising a first side and a second side, and the axial groove having a width; a filler element for being at least partially disposed in at least a portion of the axial groove to substantially bridge the groove from the first side of the groove to the second side of the groove to thereby substantially reduce cylinder vibration during rotation of the print cylinder; and the filler element comprising elastomeric material.

Another aspect of the invention resides broadly in a filler element for being at least partially disposed in at least a portion of an axial groove of a print cylinder for a rotary printing press, the print cylinder being for supporting at least one of: a rubber blanket and a printing plate about a circumference of the print cylinder, the print cylinder having a radius of curvature and defining a diameter, the axial groove for receiving ends of the at least one of: the rubber blanket and the printing plate, the axial groove comprising a first side and a second side, and the axial groove having a width, the filler element being for substantially bridging the groove from the first side of the groove to the second side of the groove to thereby substantially reduce cylinder vibration during rotation of the print cylinder, the filler element comprising elastomeric material.

BRIEF DESCRIPTION OF THE DRAWINGS

Implementation examples of the invention are schematically represented in the drawings, in which.

DESCRIPTION OF THE PREFERRED EMBODIMENTS

Figure 1:
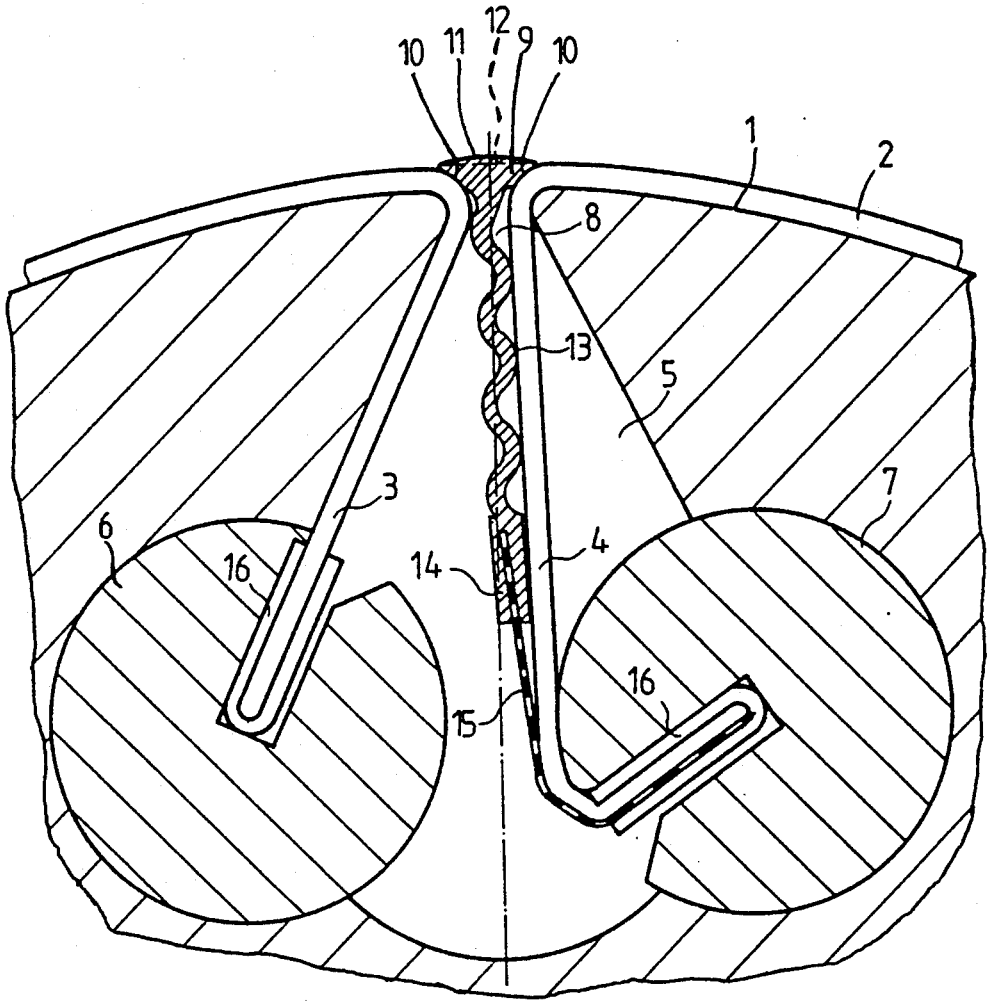
FIG. 1 shows a partial cross-section of a rubber blanket tensioning device.

FIG. 1 shows a rubber blanket cylinder 1 which is covered with a rubber blanket 2 in a well-known manner. The ends, 3, 4 of the rubber blanket 2 are fitted in tensioning spindles 6, 7 in a cylinder gap 5. The ends 3, 4 of the rubber blanket 2 are tensioned by rotation of the tensioning spindles.

A filler piece 9 is provided in the area of the cylinder gap opening 8, which filler piece is supported on the rubber blanket 2 on either side of the gap opening 8. For this, the contact surfaces 10 of the filler piece 9 are adapted to the radii of the rubber blanket 2. Instead of a rubber blanket 2, a printing plate could be tensioned in like manner, whereby the filler piece 9 would also be supported as shown.

In the implementation example shown in the diagram, the filler piece 9 is composed of elastic or elastomeric material, e.g. PERBUNAN (BUNA N). The outer contour 11 of the filler piece 9 protrudes a certain length beyond the cylinder diameter 12. The size of this projection depends on the hardness of the filler piece 9, and whether it is supported on a rubber blanket 2 or a printing plate. The outer contour 11 of the filler piece 9 is designed in such a way that, when two cylinders roll over each other, the filler pieces of the two interacting cylinders absorb the same contact pressure as the rubber blanket 2, so that cylinder vibration is avoided.

Figure 1A:
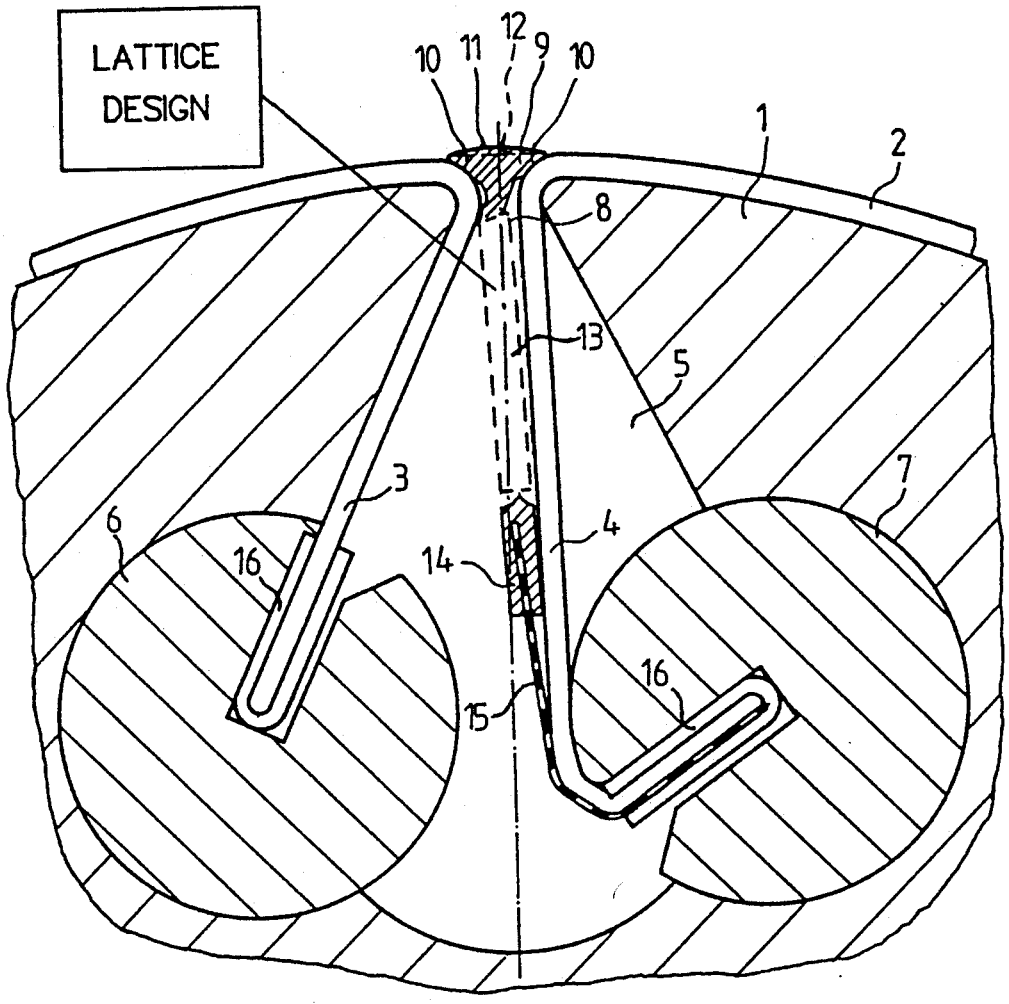
FIG. 1*a* shows a partial cross-section with a latticed filler piece.

The filler piece 9 features an elastic or elastomeric extension 13 which extends radially into the interior of the non-printing gap 5. The waved design of the extension 13 shown in the drawing permits the filler piece 9 to be firmly held in contact with the rubber blanket 2. Instead of the waved design as shown in outline form in FIG. 1A, a latticed design of the extension 13 could also be used to apply elastic forces.

The lower end 14 of the elastic or elastomeric extension 13 is attached to a foil 15 which could, for example, be a brass foil. The connection between the lower end 14 and the foil 15 can be achieved, for example, by means of vulcanization. It is advantageous if the foil 15, together with the end 4 of the rubber blanket 2, is fitted tightly into a U-shaped sheet-metal strip 16, of the type used for the ends of the rubber blankets. In this case, the elastic or elastomeric extension 13 can be fixed and tensioned, together with the rubber blanket 1, via the foil 15 through rotation of the tensioning spindle 7. The advantage of this implementation of the invention consists in the fact that the filler piece 9 can be changed or tensioned together with the rubber blanket 2 without any additional handling operations.

Figure 2:
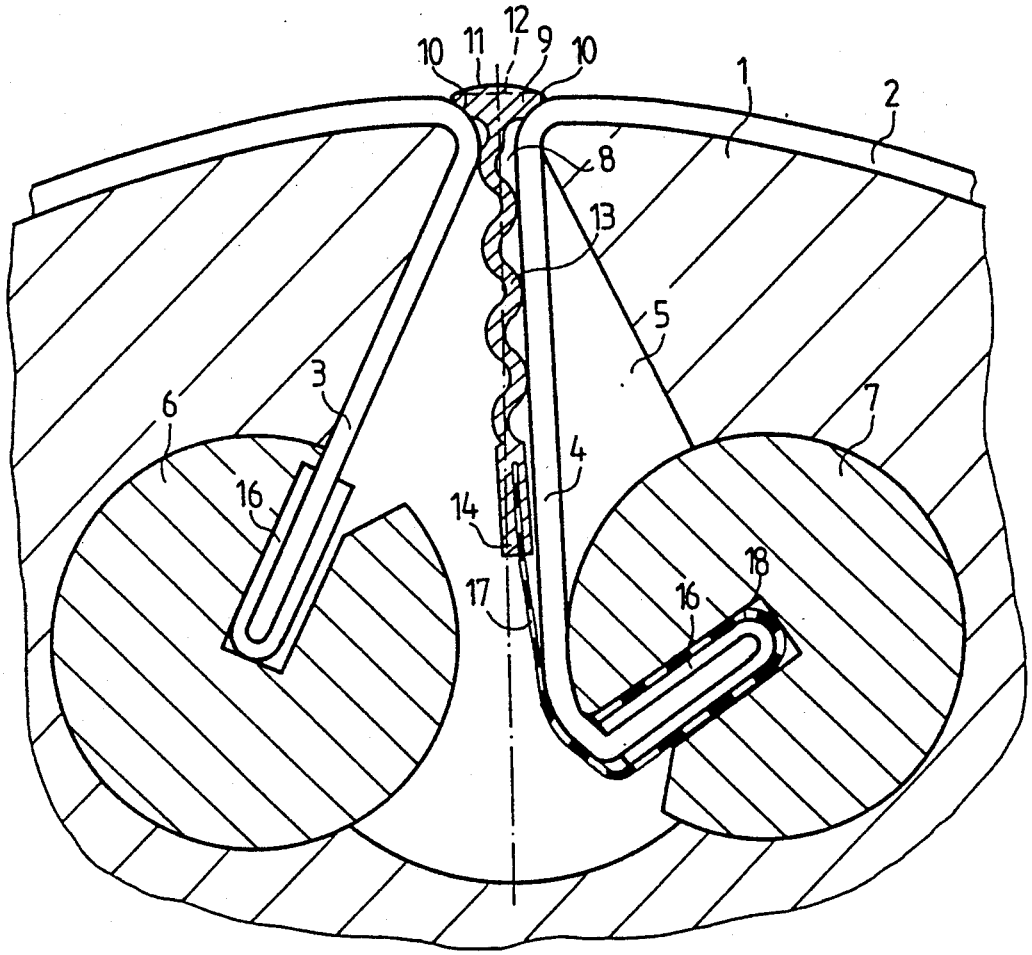
FIG. 2 shows a partial cross-section of a rubber blanket tensioning device.

The implementation of the invention shown in FIG. 2 differs from the one depicted in FIG. 1 in that the foil 17 is provided in the form of a metal foil which surrounds the U-shaped sheet-metal strip 16 in a hook-like configuration, whereby the hook-like portion 18 of the foil 17 is advantageously designed in such a manner that it covers the U-shaped sheet metal strip 16 over its total extent. This ensures firm tightening of the rubber blanket end 4.

Figure 3:
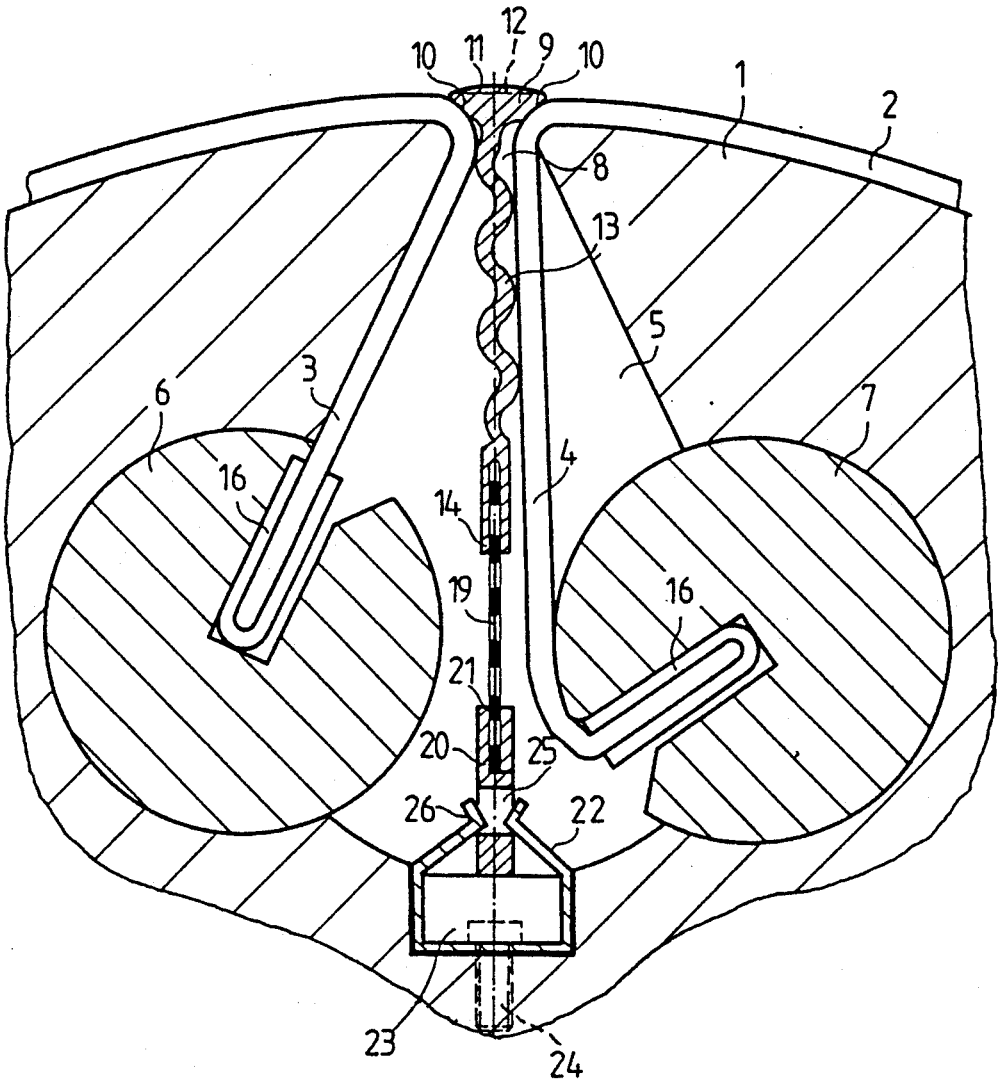
FIG. 3 shows a partial cross-section of a rubber blanket tensioning device.

In a further development variant, the foil 19 according to FIG. 3 is fixed to a bridging bar 20. Attachment can be achieved by, for example, vulcanizing the foil 19 into a slit 21 located on the bridging bar. The bridging bar 20 is advantageously fixed in the bottom of the cylinder gap via spring steel clasps 22. These are secured to the bottom by means of holders 23 and screws 24. Recesses 25 in the bridging bar 20 permit the angle-shaped ends 26 to interlock in the recesses 25, thereby retaining not only the bridging bar with the foil 19 but also the filler piece 9.

Figure 4:
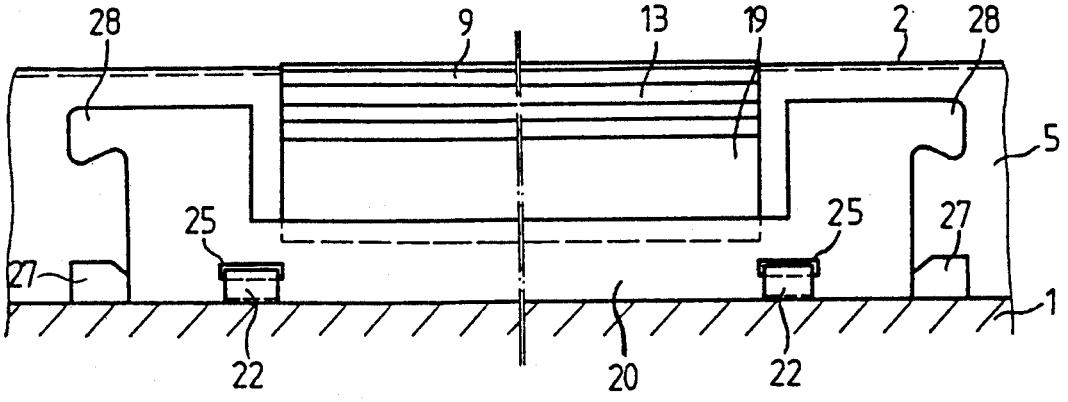
FIG. 4 shows a partial longitudinal section with an arrangement for securing the filler piece.

As is apparent from FIG. 4, the bridging bar 20 is fixed in the cylinder gap 5 via stops 27 and is provided with hook-like projections 28 at both ends which permit simple removal of the bridging bar 20 and thus of the filler piece 9.

Art hereby incorporated as reference includes U.S. Pat. No. 4,742,769 to Zeller, entitled "Printing Cylinder and Axial Groove Filler Combination", U.S. Pat. No. 4,790,245 to Fischer et. al., entitled "Support Assembly for a Cylinder Groove", and U.S. Pat. No. 4,815,380 to Fischer, entitled "Printing Machine cylinder with Adjustable Groove Cover Element".

In summary, one feature of the invention resides broadly in a print unit cylinder for rotary presses with a narrow gap parallel to the axis for accommodating the rubber blanket or printing plate ends, and with a filler piece for bridging the gap opening in such a way that, when two interacting cylinders roll over the cylinder gaps, cylinder vibration is avoided, characterized by the fact that the filler piece 9 is supported on the rubber blanket 2 or the printing plate on either side of the gap opening 8, that the filler piece 9 is composed of elastic material and has an outer contour 11 which protrudes beyond the cylinder diameter 12, and that the filler piece 9 features an elastic extension 13 which extends radially into the interior gap 5, the elastic force of this extension permitting the filler piece 9 to be firmly held in contact with the rubber blanket 2 or the printing plate.

Another feature of the invention resides broadly in a print unit cylinder characterized by the fact that the elastic extension 13 has a waved design.

Yet another feature of the invention resides broadly in a print unit characterized by the fact that the elastic extension 13 has a latticed design.

A further feature of the invention resides broadly in a print unit cylinder characterized by the fact that the lower end 14 of the elastic extension 13 is attached to a foil 15 which, together with the end 4 of the rubber blanket 2, is fitted tightly into a U-shaped sheet-metal strip 16 and is tensioned together with the rubber blanket end 4.

A yet further feature of the invention resides broadly in a print unit cylinder characterized by the fact that the foil 17 is a metal foil which surrounds the U-shaped sheet-metal strip 16 in a hook-like configuration.

Yet another further feature of the invention resides broadly in a print unit cylinder characterized by the fact that the foil 19 is fixed to a bridging bar 20 which engages in spring steel clasps 22 mounted on the bottom of the gap.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A print cylinder for a rotary printing press, said spring cylinder being for supporting at least one of: a rubber blanket and a printing plate about a circumference of the print cylinder, at least one of: the rubber blanket when supported about the print cylinder and the printing plate when supported about the print cylinder defining a diameter, said print cylinder comprising:

an axial groove disposed along the circumference of said print cylinder, the axial groove for receiving ends of the at least one of: the rubber blanket and the printing plate, the axial groove with the ends of the at least one of: the rubber blanket and the printing plate disposed therein comprising a first side, a second side, and a width;

a filler element for being disposed in the axial groove to bridge the width from the first side of the groove to the second side of the groove to thereby substantially reduce cylinder vibration during rotation of said print cylinder;

said filler element comprising elastomeric material;

said filler element having:

a first portion having a width greater than the width of the axial groove, said first portion for contacting the first side and the second side when the filler element is disposed within the axial groove; and said first portion of said filler element having an outer contour which protrudes a distance beyond said diameter when the filler element is disposed within the axial groove to thereby absorb contact pressure generally equal to contact pressure absorbed between the at least one of: the rubber blanket and the printing plate supported on the print cylinder, and an adjacent cylinder to substantially reduce cylinder vibration during said rotation of the cylinder.

2. The print cylinder according to claim 1, wherein:

the elastomeric material has a hardness; and said distance and said hardness being configured to substantially reduce cylinder vibration during said rotation of the cylinder.

3. The print cylinder according to claim 2, wherein said distance and said hardness are configured to substantially reduce cylinder vibration during said rotation of the cylinder with the at least one of: the rubber blanket and the printing plate supported about the print cylinder.

4. The print cylinder according to claim 3, wherein said filler element further comprises an extending portion extending from said first portion, said extending portion being for tensioning and retaining said filler element in the axial groove, at least a portion of said extending portion comprising elastomeric material.

5. The print cylinder according to claim 4, wherein said extending portion at least partially comprises at least one of: waves and lattices.

6. The print cylinder according to claim 5, wherein at least an additional portion of said extending portion comprises a foil adhered to said elastomeric material of said extending portion by vulcanization.

7. The print cylinder according to claim 6, wherein:

an end of the rubber blanket comprises a U-shaped clip disposed about the end of the rubber blanket;

said foil of said extending portion is for being disposed about the U-shaped clip of the rubber blanket;

said axial groove further comprises at least one tensioning device disposed therein; and the U-shaped clip with the foil disposed thereabout is for being inserted into the tensioning within the axial groove so that the rubber blanket and filler element are tensioned substantially simultaneously within the axial groove.

8. The print cylinder according to claim 7, wherein:

the tensioning device comprises tensioning spindles disposed axially within the axial grove, the tensioning spindles comprising grooves for receipt of the U-shaped clips;

said elastomeric material of said filler element comprises PERBUNAN; and said foil comprises rust-proof metal, and the rust-proof metal comprises brass.

9. The print cylinder according to claim 6, wherein:

said foil of said extending portion is adhered to an end of the rubber blanket by vulcanization, thereby forming an integral rubber blanket end comprising said filler element;

said integral rubber blanket end further comprises a U-shaped clip disposed about the integral end of the rubber blanket and foil;

said axial groove further comprises at least one tensioning device disposed therein; and the U-shaped clip disposed about the end of the rubber blanket and foil is for being disposed in the tensioning device within the axial groove so that the rubber blanket and filler element are tensioned substantially simultaneously within the axial groove.

10. The print cylinder according to claim 6, wherein: the axial groove has a bottom;

said extending portion further comprises a bridging bar for being affixed to the bottom of the axial groove;

said foil of said extending portion is adhered to the bridging bar;

the print cylinder comprises fastening means disposed at the bottom of the axial groove;

said bridging bar is for being affixed to the bottom of the axial groove by said fastening means to thereby tension said filler element in the axial groove;

said elastomeric material of said filler element comprises PERBUNAN;

said foil comprises rust-proof metal, and the rust-proof metal comprises brass;

said fastening means comprises spring-steel clasps;

said bridging bar comprises recesses for engagement with said spring-steel clasps; and said bridging bar comprises hook-like projections for removal for said bridging bar from said spring steel-clasps.

11. A filler element for use with a printing cylinder for a rotary printing press, the printing cylinder having an axial groove therein, the filler element for being disposed in the axial groove of the print cylinder, the print cylinder being for supporting at least one of: a rubber blanket and a printing plate about a circumference of the print cylinder, and at least one of: the rubber blanket and the printing plate when supported about the print cylinder defining a diameter, the axial groove for receiving ends of the at least one of: the rubber blanket and the printing plate, the axial groove with the ends of the at least one of: the rubber blanket and the printing plate disposed therein comprising a first side, a second side, and a width, said filler element comprising:

at least a first portion for bridging the groove in which the filler element is for being disposed from the first side of the groove to the second side of the groove to thereby substantially reduce cylinder vibration during rotation of the print cylinder in which the filler element is being used;

said first portion having a width greater than the width of the axial groove in which the filler element is for being disposed, said first portion for contacting the first side and the second side when the filler element is disposed within the axial groove in which the filler element is for being disposed;

said first portion having an outer contour protruding beyond said diameter when said filler element is disposed within the axial groove in which the filler element is for being disposed; and said filler element comprising elastomeric material.

12. The filler element according to claim 11, wherein: the elastomeric material has a hardness; and said distance and said hardness are configured to substantially reduce cylinder vibration during said use of the filler element in the cylinder with the at least one of: the rubber blanket and the printing plate supported about the print cylinder.

13. The filler element according to claim 12, further comprising an extending portion extending from said first portion, said extending portion being for tensioning and retaining said filler element in the axial groove in which the filler element is for being disposed, and at least a portion of said extending portion comprising elastomeric material.

14. The filler element according to claim 13, wherein said extending portion at least partially comprises at least one of: waves and lattices.

15. The filler element according to claim 14, wherein at least an additional portion of said extending portion comprises a foil adhered to said elastomeric material of said extending portion by vulcanization.

16. The filler element according to claim 15, wherein:

said foil of said extending portion is for being adhered to an end of the rubber blanket by vulcanization, thereby forming an integral rubber blanket end comprising said filler element;

said integral rubber blanket end further comprises a U-shaped clip for being disposed about the integral end of the rubber blanket and foil;

said axial groove further comprises at least one tensioning device disposed therein; and the U-shaped clip disposed about the end of the rubber blanket and foil is for being disposed in the tensioning device within the axial groove so that the rubber blanket and filler element are tensioned substantially simultaneously within the axial groove.

17. The filler element according to claim 15, wherein:

an end of the rubber blanket comprises a U-shaped clip disposed about the end of the rubber blanket;

said foil of said extending portion is for being disposed about the U-shaped clip of the rubber blanket;

said axial groove further comprises at least one tensioning device disposed therein; and the U-shaped clip with the foil disposed thereabout is for being inserted into the tensioning device within the axial groove so that the rubber blanket and filler element are tensioned substantially simultaneously within the axial groove.

18. The filler element according to claim 17, wherein:

the tensioning device comprises tensioning spindles disposed axially within the axial groove, the tensioning spindles comprising grooves for receipt of the U-shaped clips;

said elastomeric material of said filler element comprises PERBUNAN; and said foil comprises rust-proof metal, and the rust-proof metal comprises brass.

19. The filler element according to claim 15, wherein:

the axial groove in which the filler element is for being disposed has a bottom;

said extending portion further comprises a bridging bar for being affixed to the bottom of the axial groove;

said foil of said extending portion is for being adhered to the bridging bar;

the print cylinder comprises fastening means disposed at the bottom of the axial groove; and said bridging bar is for being affixed to the bottom of the axial groove by said fastening means to thereby tension said filler element in the axial groove substantially independently from the rubber blanket.

20. The filler element according to claim 19, wherein:

said elastomeric material of said filler element comprises PERBUNAN;

said foil comprises rust-proof metal, and the rust-proof metal comprises brass;

said fastening means comprises spring-steel clasps;

said bridging bar comprises recesses for engagement with said spring-steel clasps; and said bridging bar comprises hook-like projections for removal of said bridging bar from said spring steel-clasps.

* * * * *